US005228864A

United States Patent [19]

Fusselman et al.

[11] Patent Number: 5,228,864

[45] Date of Patent: * Jul. 20, 1993

[54] CONNECTORS WITH GROUND STRUCTURE

[75] Inventors: David F. Fusselman, Middletown; Peter K. Townsend, Camp Hill, both of Pa.

[73] Assignee: E. I. Du Pont de Nemours and Company, Wilmington, Del.

[ * ] Notice: The portion of the term of this patent subsequent to Aug. 4, 2009 has been disclaimed.

[21] Appl. No.: 766,693

[22] Filed: Sep. 27, 1991

Related U.S. Application Data

[62] Division of Ser. No. 536,855, Jun. 8, 1990, abandoned.

[51] Int. Cl.[5] ..... H01R 4/66

[52] U.S. Cl. ..... 439/108; 439/607

[58] Field of Search ..... 439/81, 80, 607-610, 439/79, 108, 95

[56] References Cited

U.S. PATENT DOCUMENTS

| | | | |
|---|---|---|---|
| 4,451,107 | 5/1984 | Dola et al. | 339/143 |
| 4,568,134 | 2/1986 | DeMondi | 339/17 |
| 4,601,527 | 7/1986 | Lemke | 439/81 |
| 4,601,527 | 7/1986 | Lemke | 339/14 |
| 4,655,518 | 4/1987 | Johnson et al. | 339/17 |
| 4,686,607 | 8/1987 | Johnson | 439/80 |
| 4,806,107 | 2/1989 | Arnold et al. | 439/79 |
| 4,824,383 | 4/1989 | Lemke | 439/108 |
| 4,836,791 | 6/1989 | Grabbe et al. | 439/79 |
| 4,840,573 | 6/1989 | Seidel et al. | 439/92 |
| 4,846,727 | 7/1989 | Glover et al. | 439/608 |
| 4,867,690 | 9/1989 | Thumma | 439/79 |
| 4,869,677 | 9/1989 | Johnson et al. | 439/80 |
| 4,874,319 | 10/1989 | Hasircoglu | 439/608 |
| 4,898,546 | 2/1990 | Elco et al. | 439/608 |
| 4,914,062 | 4/1990 | Voltz | 439/608 |
| 4,952,172 | 8/1990 | Barkus et al. | 439/532 |
| 4,959,024 | 9/1990 | Czeschka | 439/607 |
| 4,975,084 | 12/1990 | Fedder et al. | 439/608 |

FOREIGN PATENT DOCUMENTS

| | | | |
|---|---|---|---|
| 0365179 | 4/1990 | European Pat. Off. | 13/658 |
| 3904461 | 9/1990 | Fed. Rep. of Germany | 13/658 |

*Primary Examiner*—Larry I. Schwartz
*Assistant Examiner*—Hien D. Vu

[57] ABSTRACT

The present invention relates to electrical connectors with a ground structure for impedance and cross talk control between signal carrying conductors.

5 Claims, 3 Drawing Sheets

CONNECTORS WITH GROUND STRUCTURE

CROSS REFERENCE TO RELATED APPLICATION

This is a divisional application of copending U.S. patent application Ser. No. 07/536,855 filed Jun. 8, 1990 now abandoned.

BACKGROUND OF THE INVENTION

1. Field of the Invention

This invention relates to electrical connectors with a ground structure for impedance and cross talk control between signal carrying conductors.

2. Description of Related Art

With the advance of technology, a high density of electronic circuits and components can be located on a printed wiring board or printed circuit board (PCB). Along with this miniaturization of electronic circuits and components, electrical connectors are needed to electrically and mechanically interconnect one PCB, such as a back panel or mother board, to one or more other PCBs, such as daughter boards. Further, it is typically desirable for such connectors to have a high signal density capacity. That is, the connectors should permit a high number of signals to pass through the connector per unit volume of the connector. However, electrical signals carried on a conductor can interfere with a signal carried on an adjacent conductor.

This interfering electrical effect that an electrical signal carried on a given conductor exerts on a signal carried on an adjacent conductor is referred to as "cross talk." Controlling this cross talk is especially important in high density connectors. Such control can be implemented in a variety of ways.

One method of controlling cross talk is to connect certain terminals in a high density connector to conductive areas of a printed circuit board that are in turn grounded or connected to a predetermined ground potential. This solution is external to the connector.

U.S. Pat. Nos. 4,655,518 (to Lennart B. Johnson et al.), 4,686,607 (to Lennart B. Johnson) and 4,869,677 (to Lennart B. Johnson et al.) disclose a daughter board/backplane assembly with contact elements dedicated for grounding purposes. Header contact elements have contacts that can be connected to ground or a predetermined potential on a backplane. The header contact elements have other spring contacts carried by an inside header wall for touching contacts carried by a right angle receptacle outer wall. Other contacts are integral with and perpendicular to the contacts carried by the right angle receptacle outer wall for connection to the daughter board.

U.S. Pat. No. 4,601,527 issued to Timothy A. Lemke discloses an internal shielding structure for connectors, specifically in vertical and right angle headers. The shielding structure includes a ground strip affixed to a mating surface of a header housing. The shielding structure further includes an elongated conductive spring contact with contact beams that extend in holes of side walls of the housing, lock tabs that connect to the ground strip and ground bars for connection to a grounded chassis.

U.S. Pat. No. 4,824,383 issued to Timothy A. Lemke discloses a shielding structure in connectors or plug-type terminators for either a multiple conductor cable or a multiple tracing substrate that electrically isolates individual or groups of contact elements in the terminator to prevent or minimize cross talk between adjacent conductors and to prevent or minimize degradation of signal transmission. The terminator includes a ground structure with generally U-shaped channels. Contact elements extend into the channels. The ground structure is connected to a predetermined potential, rather than dedicating some of the contact elements for this purpose.

U.S. Pat. No. 4,898,546 issued to Richard A. Elco et al. discloses a ground shield device for right angle connectors. A different one of the shield devices straddles alternate columns of contact elements in the connector. Each shield device clips to a tail of one of the contact elements straddled by the shield device. The shield devices are connected to ground or a predetermined potential.

It is an object of this invention to provide high density electrical connectors for electrically and mechanically interconnecting electronic circuits and/or components controlling impedance and/or cross talk within the connectors.

Furthermore, it is an object of this invention to provide high density electrical connectors for electrically and mechanically interconnecting a circuit assembly and a plurality of terminals arranged in rows and columns in a mating connector to control impedance and/or cross talk thereby to reduce, prevent or minimize degradation of signal transmission within the receptacles.

SUMMARY OF THE INVENTION

The present invention is directed to an electrical connector for electrically and mechanically interconnecting a circuit assembly having a plurality of contact regions and a mating connector having first side walls, a plurality of first contacts arranged in rows and columns within the first side walls and at least one second side contact, the connector comprising:

an insulative housing having second side walls and a plurality of passages arranged in rows and columns within the second side walls;

a first plurality of electrical contact elements wherein:

each contact element has a third contact and a fourth contact, the third contacts generally parallel to or colinear with the fourth contacts, one of the third contacts is in each of the passages for contacting the first contacts;

at least one conductor having at least one fifth contact, at least one sixth contact and a bent end portion, the at least one fifth contact on one of the second side walls for contacting the at least one second contact on one of the first side walls, the sixth contacts generally parallel to or colinear with the fifth contacts, the bent end portion for extending into a groove in a mating surface of the connector; and an insulative spacer having a plurality of holes arranged in rows and columns, the contact elements extending through some of the holes and the sixth contacts extending through a remainder of the holes such that the fourth and sixth contacts are on one side of the spacer and the third and fifth contacts are on another side of the spacer.

BRIEF DESCRIPTION OF THE DRAWINGS

The invention can be more fully understood from the following detailed description thereof in connection with accompanying drawings which form a part of this application and in which.

DESCRIPTION OF THE PREFERRED EMBODIMENT(S)

Figure 1:
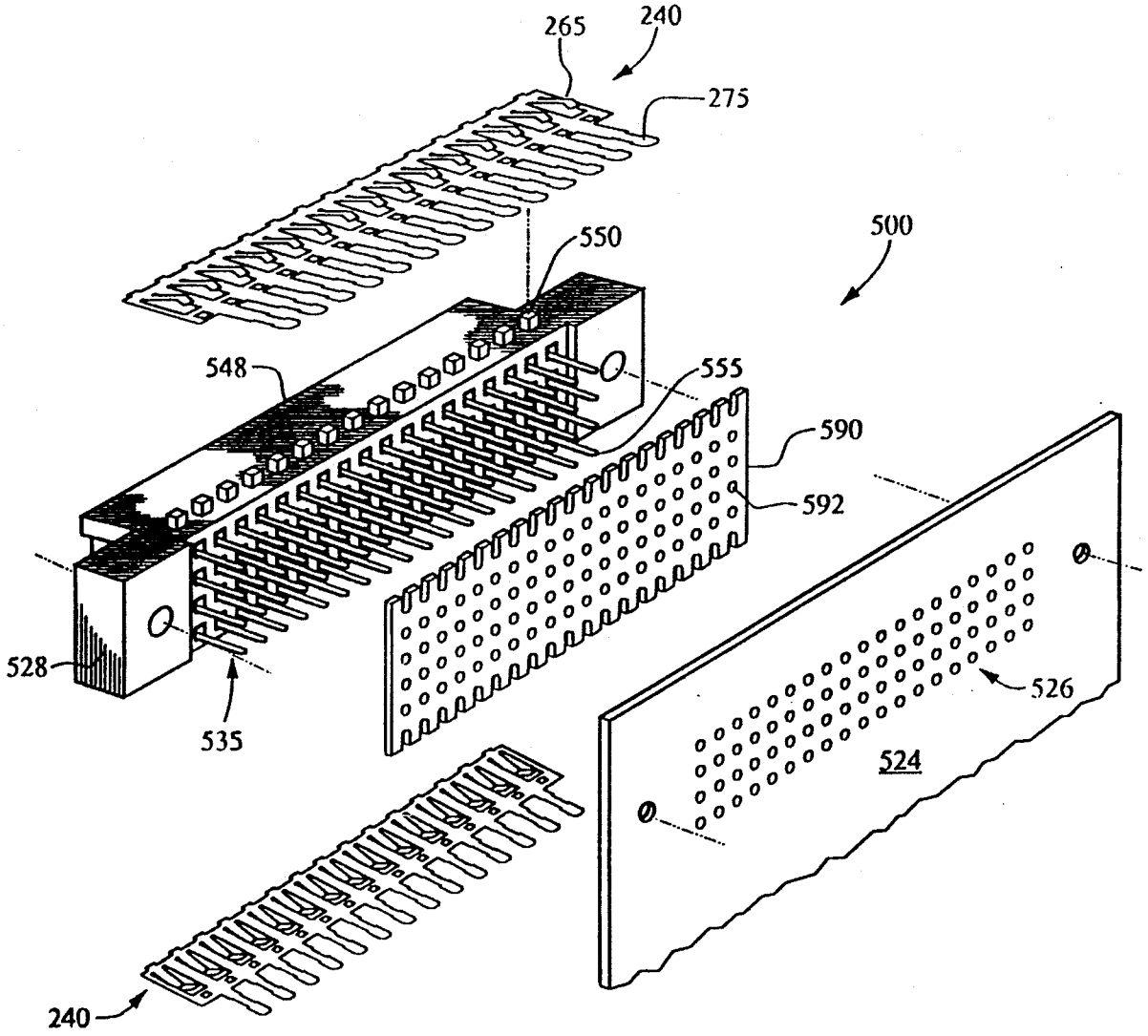
FIG. 1 is an exploded perspective view of a high density connector assembly in accordance with the present invention, the assembly including a high density vertical connector for interconnecting a circuit assembly and a mating connector.

Throughout the following detailed description, similar reference characters refer to similar elements in all figures of the drawings.

Referring to FIG. 1, there is illustrated an exploded perspective view of a high density connector assembly in accordance with the present invention. The assembly includes a high density vertical connector or receptacle 500 for interconnecting a circuit assembly 524 and a mating connector (not depicted). The electrical receptacle 500 is for electrically and mechanically interconnecting the circuit assembly 524 having a plurality of contact regions 526 and a mating connector having first side walls, a plurality of first contacts arranged in rows and columns within the first side walls and at least one second contact. Suitable connectors that can be used for mating with the connector 500 of the present invention are disclosed in U.S. patent application Ser. No. 07/536,855 filed Jun. 8, 1990, which is hereby incorporated by reference.

Figure 2:
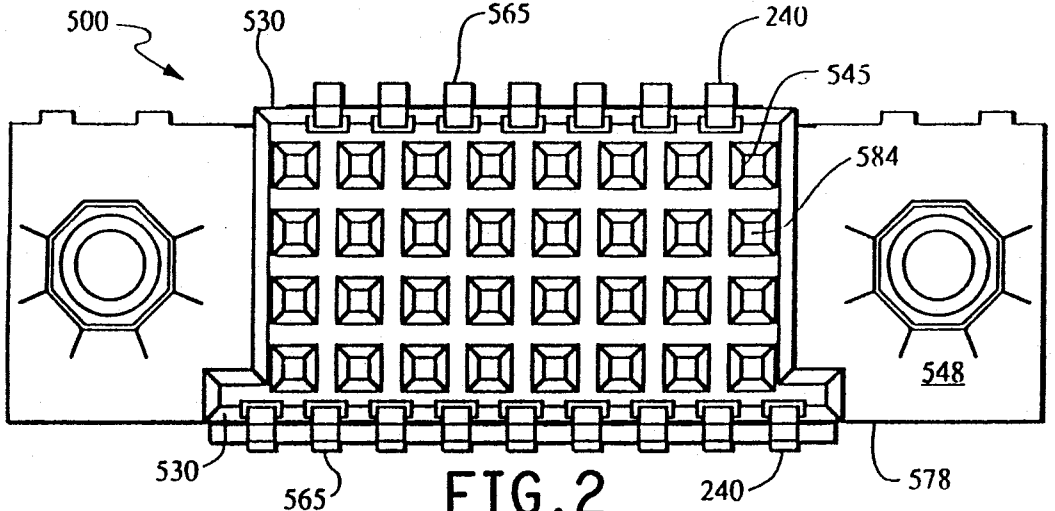
FIG. 2 is an enlarged view of the top or first mating side of the high density vertical connector of FIG. 1.
Figure 4:
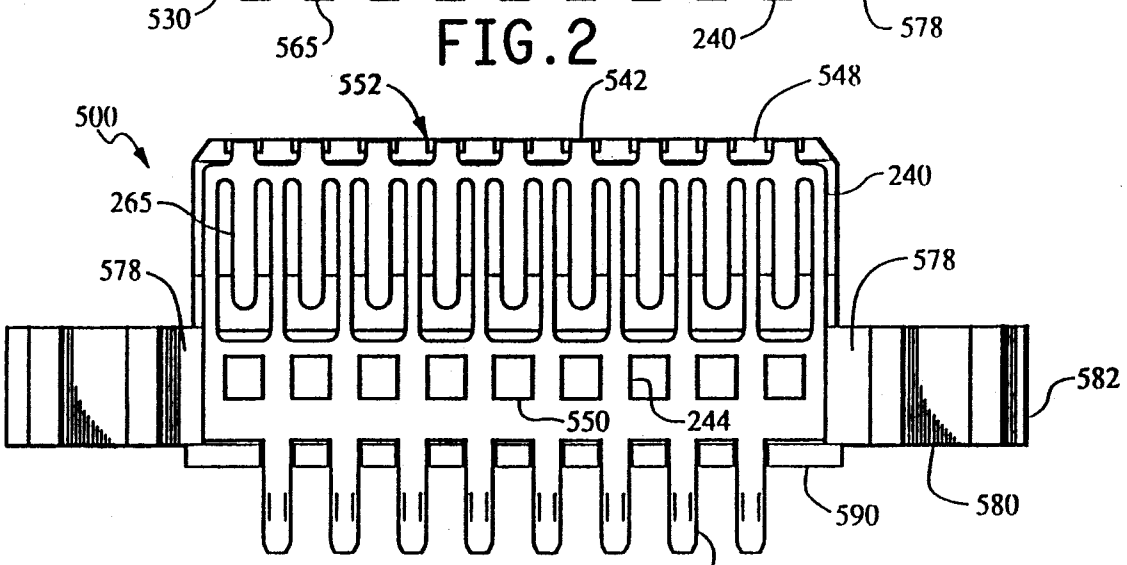
FIG. 4 is an enlarged view of a front side of the vertical connector of FIG. 1.
Figure 5:
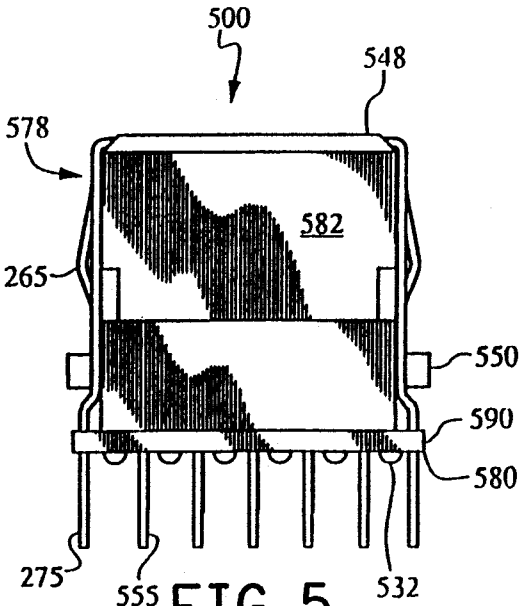
FIG. 5 is an enlarged view of an end of the vertical connector of FIG. 1.
Figure 3:
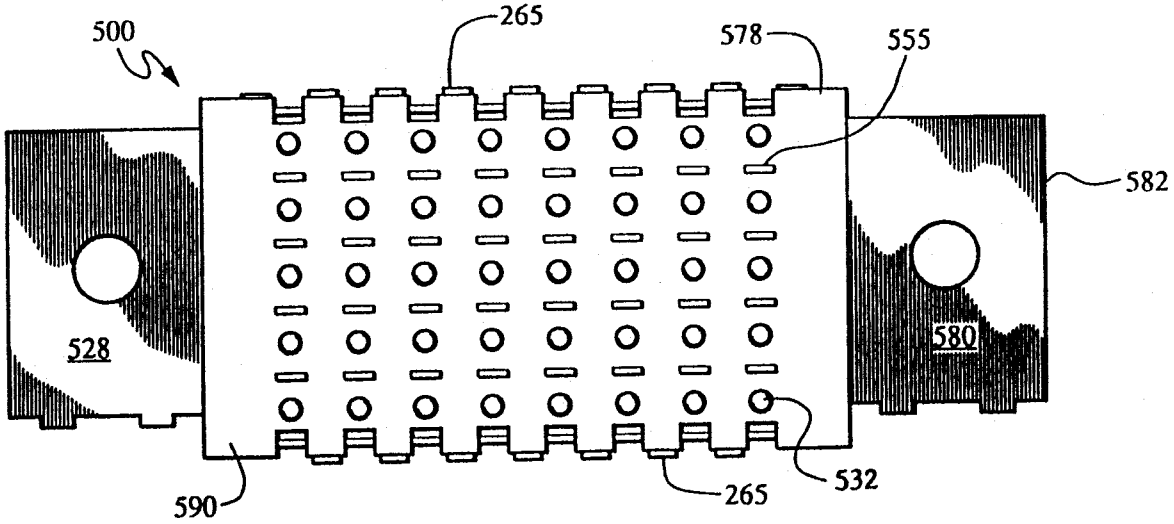
FIG. 3 is an enlarged view of a bottom or second mating side of the vertical connector of FIG. 1.
Figure 6:
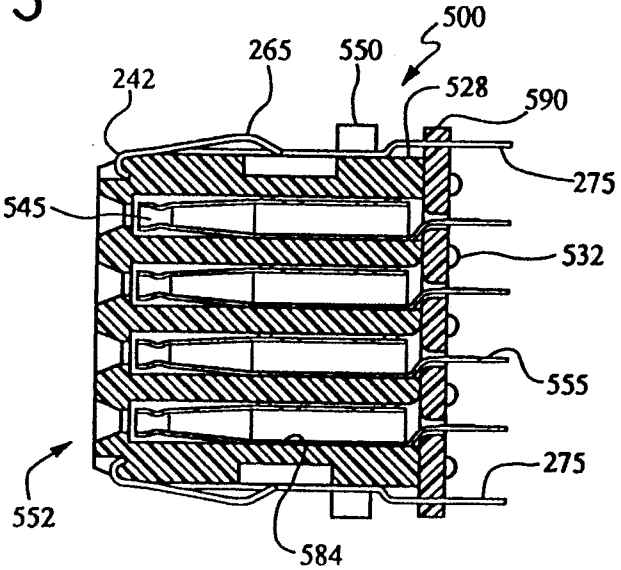
FIG. 6 is a sectional view of the vertical connector of FIGS. 1-5.

FIG. 2 is an enlarged view of the top or first mating side 548 of the high density vertical receptacle 500 of FIG. 1. FIG. 3 is an enlarged view of a bottom or second mating side 580 of the vertical receptacle 500 of FIG. 2. FIG. 4 is an enlarged view of a front side 578 of the vertical receptacle 500 of FIG. 1. FIG. 5 is an enlarged view of an end 582 of the vertical receptacle 500 of FIG. 1. FIG. 6 is an enlarged cross section of the receptacle 500 of FIG. 1.

The vertical receptacle 500 comprises an insulative housing 528, a plurality of first conductive electrical contact elements 535 mounted in the housing 528, at least one conductor 240 and an insulative spacer 590.

Referring, for instance, to FIG. 2, the insulative housing 528 has a first, header or shroud, mating surface 548, second side walls 530 and a plurality of passages 584 within the second side walls 530. The passages 584 are arranged in rows and columns extending perpendicularly from the first mating surface 548 through the housing 528. The housing 528 may have any means for aligning the housing 528 with the conductors 240. The housing alignment means may comprise projections or slots 550. See FIGS. 1 and 4.

The conductive electrical contact elements 535 may have any configuration so long as they are useable as vertical contact elements. In other words, they may be male elements, female elements or gender neutral. More specifically, referring to FIG. 6, each one of the conductive electrical contact elements 535 has a third contact 545 and a fourth contact 555. Preferably, the third contacts 545 are generally parallel to or colinear with the fourth contacts 555. The third contacts 545 can be socket shaped or spring beams. The fourth contacts 555 can be substantially flat solder tails. One of the third contacts 545 is secured in each one of the passages 584 for contacting one of the contacts of a mating connector. The third contacts 545 are generally parallel to one another and arranged in rows and columns. There can be any number of rows and any number of columns of the third contacts 545. However, there are preferably at least two rows and at least two columns. Typically, there are three, four, five or six rows of the third contacts 545. The Figures depict four rows of the third contacts 545. Typically, there are many columns of the third contacts 545. The fourth contacts 555 can be through mount contacts or surface mount contacts.

Each one of the conductors 240 has at least one fifth contact 265 and at least one sixth contact 275. Preferably, each one of the conductors 240 has a plurality of the fifth contacts 265 and a plurality of the sixth contacts 275. The fifth contacts 265 on each of the conductors 240 are on one of the second side walls 530 for contacting the side contacts on one of the first side walls of a mating connector. Preferably, the fifth contacts 265 on each of the conductors 240 is on an exterior surface of one of the second side walls 530. Preferably, there are two of the conductors 240 and the conductors 240 are on different ones of the second side walls 530 that are generally parallel to the rows of the contact elements 535. Each one of the conductors 240 can be an elongated shield member as illustrated in the Figures with at least one bent end portion 242 for extending into corresponding retaining grooves or slots 552 in the mating surface 548 of the connector 500. Alternatively, each one of the conductors 240 can comprise a plurality of individual conductor elements with each one of the conductor elements having one of the fifth contacts 265 and one of the sixth contacts 275. The conductors 240 can be "on" the side walls 530 by any means. For instance, the fifth contacts 265 of the conductors 240 can be a conductive coating on the side walls 530. The conductors 240 may have any means for securing the conductors 240 to the housing 528 and/or any means for aligning the conductors 240 with the housing 528. Referring to FIG. 4, the conductor securing and alignment means may comprise slots or projections 244. Thus, when the bent end portions 242 are extending into the retaining grooves or slots 552 and the slots 244 are pressed onto the projections 550, then the conductor 240 is secured on the second side wall 530 and properly aligned.

Referring, for instance, to FIGS. 1, 3 and 6, the vertical electrical receptacle 500 may further include an insulative spacer 590 having a plurality of holes or slots 592 arranged in rows and columns. The contact elements 535 can extend through the holes 592 such that the sixth contacts 275 and the fourth contacts 555 are on one side of the spacer 590 and the third contacts 545 and the fifth contacts 265 are on another side of the spacer 590. The spacer 590 can have stand offs 532 for providing a distance or space between the spacer 590 and the circuit assembly 524.

The third contacts 545 of the high density receptacle 500 can connect to any connector having a plurality of terminals or contact elements with a plurality of first contacts arranged in rows and columns in a contact region of a housing secured to the terminals or a shroud surrounding the terminals, the connector having at least one second side contact for engaging at least one of the fifth contacts 265. The header that is mateable with the receptacle 500 can be a vertical header or an angled or right angle header. Preferably, the terminals of the header that is mateable with the receptacle 500 are pins having a 0.24 inches by 0.24 inches square cross section. The circuit assembly 524 can be any assembly that includes a plurality of conductors, leads, plated through holes or conductive paths, pads or areas 526. The circuit assembly 524 can be a printed wiring board or a printed circuit board, such as a backpanel, a mother board or a daughter board. The circuit assembly 524 can be a cable assembly. The circuit assembly 524 can be rigid or flexible. In one typical situation, the receptacle 500 is for electrically and mechanically connecting to a mating header which, in turn, is for connecting to a backpanel or mother board; further, the receptacle 500 is for electrically and mechanically connecting to a daughter board 524 that is perpendicular to the mother board.

It will be recognized by those skilled in the art that the ground structure of the present invention can be modified to be used on any angled receptacle or header where the two contacts of the contact elements of the receptacle or header are at an angle other than 180 degrees from one another.

The parts referred to throughout this specification can be made from known materials used to make similar conventional parts. For instance, the insulative housings can be made of various plastics, such as polyetherimide resin or polyphenylene sulfide resin. The conductive walls, conductive bases, baffles and shields can be made of any nonmagnetic metal or metal alloy including zinc, aluminum, copper, brass or alloys thereof. The contact elements of the present invention can be made from any suitable metal used for electrical terminals, such as brass, phosphor bronze, beryllium copper and the like. The contact elements may be plated or coated with a conductive layer, such as tin, nickel, palladium, gold, silver or a suitable alloy.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An electrical connector for electrically and mechanically interconnecting a circuit assembly having a plurality of contact regions and a mating connector having first side walls, a plurality of first contacts arranged in rows and columns within the first side walls and at least one second side contact, the connector comprising:

an insulative housing having second side walls and a plurality of passages arranged in rows and columns within the second side walls;

a first plurality of electrical contact elements wherein:

each contact element has a third contact and a fourth contact, the third contacts generally aligned with the fourth contacts, one of the third contacts is in each of the passages for contacting the first contracts, the fourth contacts for connecting to a first set of the contact regions on the circuit assembly;

at least one conductor having at least one fifth contact, at least one sixth contact and a bent end portion, the at least one fifth contact on an exterior surface of one of the second side walls for contacting the at least one second contact on one of the first side walls, the sixth contacts generally aligned with the fifth contacts, the sixth contacts generally extending in the same direction as the fourth contacts and for connecting to a second set of the contact regions on the circuit assembly, the bent end portion for extending into a groove in a mating surface of the connector; and an insulative spacer having a plurality of holes arranged in rows and columns, the contact elements extending through some of the holes and the sixth contacts extending through a remainder of the holes such that the fourth and sixth contacts are on one side of the spacer and the third and fifth contacts are on another side of the spacer.

2. The electrical connector of claim 1, wherein the at least one fifth contact is on an exterior surface of one of the second side walls.

3. The electrical connector of claim 1, wherein there are two of the conductors and the conductors are on different ones of the second side walls that are generally parallel to the rows of the contact elements.

4. The electrical connector of claim 1, wherein the conductor has a plurality of the fifth contacts and a plurality of the sixth contacts.

5. The electrical connector of claim 1, wherein the housing has a plurality of projections and the at least one conductor has a plurality of slots or holes for receiving the projections.

* * * * *